US005220728A

United States Patent [19]

Ueno et al.

[11] Patent Number: 5,220,728

[45] Date of Patent: Jun. 22, 1993

[54] BLADE FOR BLADE EXCHANGEABLE RAZOR

[75] Inventors: Masayuki Ueno; Shouji Ueno, both of Seki, Japan

[73] Assignee: Feather Safety Razor Co., Ltd., Osaka, Japan

[21] Appl. No.: 825,948

[22] Filed: Jan. 27, 1992

[51] Int. Cl.[5] ..... B26B 21/12; B26B 21/10

[52] U.S. Cl. ..... 30/30; 30/53

[58] Field of Search ..... 30/346, 30, 31, 346.5, 30/349, 329, 53, 55

[56] References Cited

U.S. PATENT DOCUMENTS

| | | | |
|---|---|---|---|
| 1,634,788 | 7/1927 | McGlashan | 30/30 |
| 1,643,757 | 9/1927 | Wallenbeck | 30/30 |
| 2,288,299 | 6/1942 | Pileggi | 30/30 |
| 2,593,574 | 4/1952 | La Crosse | 30/30 |
| 3,054,180 | 9/1962 | Gore | 30/30 |
| 3,106,020 | 10/1963 | Tape | 30/30 |
| 4,037,322 | 7/1977 | Bresler | 30/30 |

*Primary Examiner*—Frank T. Yost
*Assistant Examiner*—Hwei-Siu Payer
*Attorney, Agent, or Firm*—Ladas & Parry

[57] ABSTRACT

A blade for a blade exchangeable razor is provided which realizes easy use and smooth haircutting. The razor is adapted to exchangeably support a blade by a blade holder. The blade comprises a thin blade portion having an edge and a back support including side plates for supporting the thin blade portion therebetween and a pair of protrusions formed on the side plates in the longitudinal direction thereof at positions of the side plates close to lower ends of the blade holder. Since the pair of protrusions on the side plates of the back support are located proximal to the lower ends of the blade holder, hair cut by the edge moves away from the blade holder by the action of the protrusions, thereby preventing the cut hair from entering between the back support and the blade holder.

11 Claims, 3 Drawing Sheets

BLADE FOR BLADE EXCHANGEABLE RAZOR

BACKGROUND OF THE INVENTION

1. Field of the Invention

The present invention relates to an improvement in a blade for a blade exchangeable razor used, for example, by a hairdresser.

2. Description of the Prior Art

A blade exchangeable razor is widely utilized since a goodlooking and natural hair style can be obtained when hair is cut or trimmed by using such a razor.

A prior art blade exchangeable razor provided with a comb-type edge, as shown in FIG. 8, is constructed in a manner that a blade 31 having a back support 30 is inserted into a blade holder 32 from the front thereof, and a guard 34 having an edge 33 is further mounted from the front end of the blade holder 32.

This type of razor, however, has a drawback that the haircutting cannot be done smoothly due to a relatively large thickness of the edge portion which is caused by the construction where the blade 31 with the back support 30 is inserted into a gap formed in the blade holder 32 and the guard 34 with the edge 33 is further mounted thereover. Another defect is encountered that cut hair enters between the blade holder 32 and the back support 30, which makes the razor difficult to use.

SUMMARY OF THE INVENTION

In view of the above-mentioned problems encountered in the conventional razors, it is an object of the present invention to provide a blade for a blade exchangeable razor which is capable of providing smooth haircutting.

It is another object of the present invention to provide an easy-to-use blade for a blade exchangeable razor which prevents cut hair from entering between a blade holder and a back support.

To achieve the above objects, the present invention provides a blade comprising a thin blade portion 8 and a back support 9 which is adapted to be exchangeably mounted in a blade holder of a razor, wherein the thin blade portion 8 is closely inserted between both side plates 9*a* and 9*b* of the back support 9, two lower ends 14 of a blade holder are closely placed to each other, and a pair of protrusions 12 are formed longitudinally on the respective side plates 9*a* and 9*b* of the back support 9.

The present invention also provides a blade comprising a thin blade portion 8 and a back support 9 which is adapted to be exchangeably mounted in a blade holder of a razor, wherein one side plate 9*a* of the back support 9 for fixing the blade thin blade portion 8 extends to a midway point of the thin blade portion 8 while the other side plate 9*b* extends to a position beyond an edge 10 such that the lower end of the side plate 9*b* covers the edge 10 with a constant gap therebetween, thereby forming a comb-type edge 11.

As described above, since the pair of protrusions 12 formed longitudinally on the side plates 9*a* and 9*b* of the back support 9 are located proximal to the lower ends 14 of the blade holder, hair cut by the edge 10 moves away from the blade holder 13 by the action of the protrusions 12, thereby preventing the cut hair from entering between the back support 9 and the blade holder 13.

Also, the protrusions 12 are formed at positions closer to the edge 10 of the thin blade portion 8, that is, at positions in the lower half of the thin blade portion 8, thereby making cut hair smoothly move toward the protrusions 12.

The thickness of the cutting portion of the razor is the sum of the thickness of the thin blade portion 8 and that of the blade holder 13, which is thinner than a conventional razor which comprises a combination of individual back support and comb-type edge. Since the finish of hairdressing is largely related to the thickness of the cutting portion of a razor, the blade of the present invention having an extremely thin cutting portion can provide a natural finish of hairdressing.

Further, the comb-type edge 11 is formed integrally with the back support 9, so that insertion of the blade into the blade holder 13 is the only process to use a razor having the comb-type edge 11. Furthermore, the comb-type edge 11 is located close to the thin blade portion 8, which provides an easy-to-use razor and satisfactory hairdressing.

The above and other objects, features and advantages of the present invention will become more apparent from the following description of the preferred embodiments of the invention when considered in conjunction with the accompanying drawings.

DESCRIPTION OF THE PREFERRED EMBODIMENTS

A first embodiment of the present invention will hereinafter be described with reference to the accompanying drawings.

Figure 2:
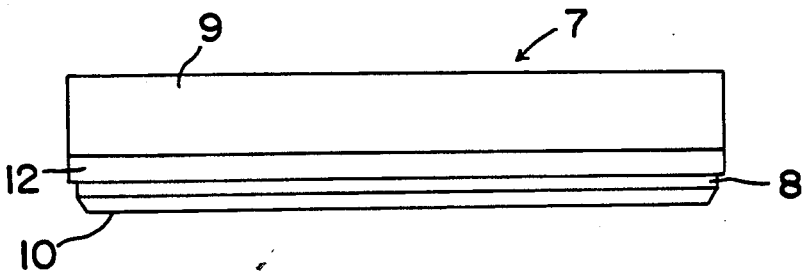
FIG. 2 is a side view of the blade shown in FIG. 1.

A blade 7 of the invention, as shown in FIG. 2, comprises a rectangular thin blade portion 8 and a back support 9. The back support 9 is formed of a curved top portion 9*c* and a pair of side plates 9*a* and 9*b* extending to form a U-shape as a whole. The side plates 9*a* and 9*b* of the back support 9 are respectively formed with a pair of outwardly protruding protrusion 12*a* and 12*b* in the longitudinal direction. One 12*a* of the protrusions has a longitudinally extending upper end 26*a* and a longitudinally extending lower end 26*b*, and the longitudinally lower end 26*b* terminates before the cutting edge of the thin blade portion 8, and the other protrusion 12*b* has a longitudinally extending upper end 26*c* and a longitudinally extending lower end 26*d*, and the lower end of the other protrusion 12*b* extending beyond the cutting edge 10 of the thin blade portion 8 such that the lower end 26*d* of the other protrusion cover the cutting edge 10 with predetermined gaps in the associated side plate 9*b* to thereby form a comb-type edge 11 adjacent the cutting edge 10. These protrusions 12 are placed at positions near an edge 10, that is, at positions in the lower half of the thin blade portion 8, and also close to lower ends 14 of a blade holder. Here, "the protrusions 12 are close to the lower ends 14 of the blade holder" includes a case where the protrusions 12 are in contact with the lower ends 14 of the blade holder (as shown in FIG. 3) and a case where a slight gap is interposed between the protrusions 12 and the lower ends 14 of the blade holder (as shown in FIG. 5).

The protrusions 12 are formed substantially in a hemisphere or triangular shape and made hollow. The thin blade portion 8 has its top end brought in contact with the top portion 9*c* of the back support 9 and its central portion also brought in contact with base ends of the protrusions 12 in a sandwich manner, such that the thin blade portion 8 is supported by both side plates 9*a* and 9*b* of the back support 9.

Figure 4:
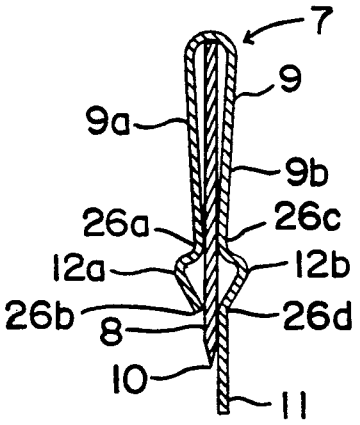
FIG. 4 is a cross-sectional view showing a blade for a blade exchangeable razor in another construction.
Figure 7:
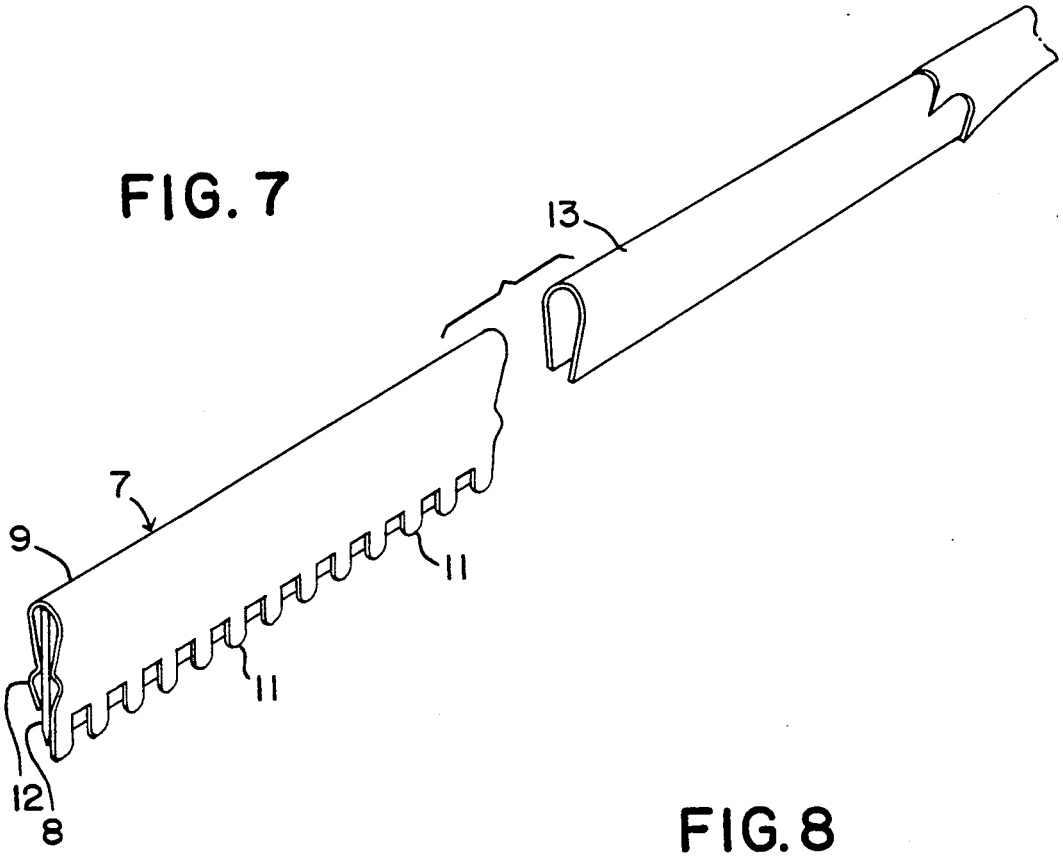
FIG. 7 is a perspective view showing a blade and a blade holder.
Figure 8:
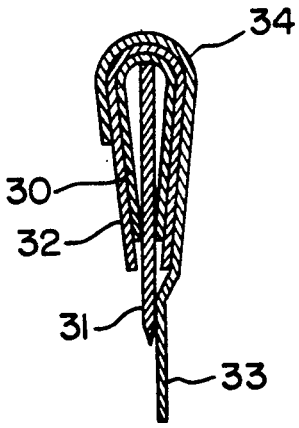
FIG. 8 PRIOR ART
FIG. 8 is a front view showing a prior art blade with a comb-type edge.

Next, a blade according to a second embodiment of the invention will be described. A blade 7, as shown in FIG. 4, comprises a thin blade portion 8 supported by side plates 9*a* and 9*b* of a back support 9 in a sandwich manner. One of the side plates 9*a* extends to a midway point of an edge 10 of the thin blade portion 8 while the other side plate 9*b* extends to a position beyond the edge 10 such that the lower end of the side plate 9*b* covers the edge 10 with a constant gap therebetween, thereby forming a comb-type edge 11 (see FIG. 5). The blade 7 is exchangeable and mounted in a blade holder 13 by sliding the same into the blade holder 13 from the front side thereof (see FIG. 7).

Figure 1:
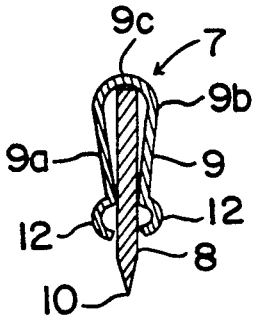
FIG. 1 is a cross-sectional view showing a blade for a blade exchangeable razor according to the present invention.
Figure 3:
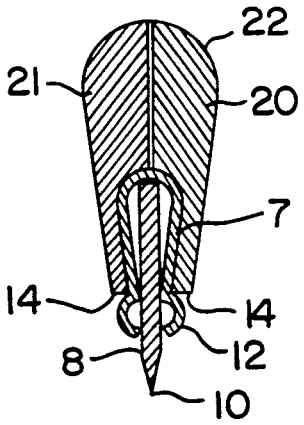
FIG. 3 is a cross-sectional view of the blade shown in FIG. 1 when it is held by a blade holder.
Figure 5:
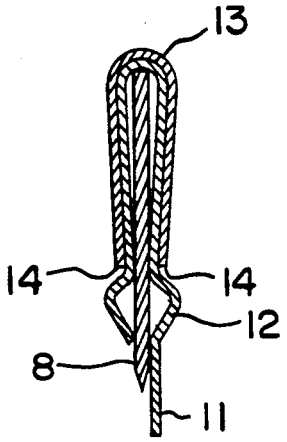
FIG. 5 is a cross-sectional view of the blade shown in FIG. 4 when it is held by a blade holder.
Figure 6:
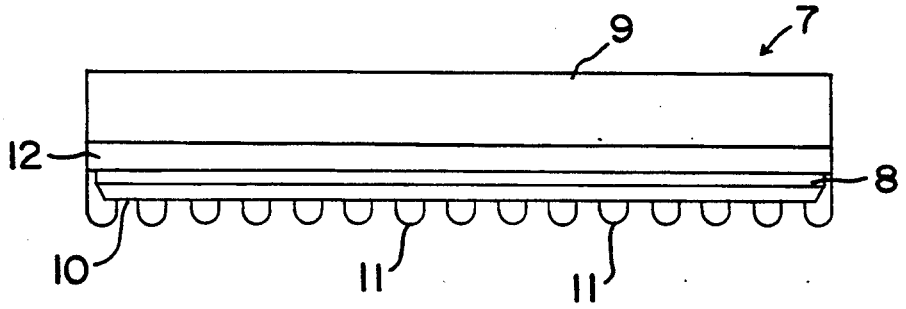
FIG. 6 is a side view of the blade shown in FIG. 4.

Incidentally, although the blade holder 22 shown in FIG. 3 comprises a blade mounting plate 20 and a separate side plate 21, while the blade holder 13 is shown in FIG. 5 is integrally formed, the blade holder may be constructed in various different manners.

Also, the blade 7 is manufactured using a thin tape-shaped metal plate wound in a roll form. Respective manufacturing processes may be executed on this tape-shape metal plate, and individual blades may be cut in the final stage.

Various other modifications of the illustrative embodiment, as well as other embodiments of the present invention, will be apparent to any person skilled in the art upon reference to the above description. It is therefore contemplated that the appended claims will cover any such modifications of embodiments as fall within the true scope of the invention.

We claim:

1. A blade for a blade exchangeable razor which is adapted to be exchangeably mounted in a blade holder of the razor, the blade holder having a bifurcated opening for temporarily receiving the blade, the bifurcated opening having spaced apart lower ends, said blade comprising:

a thin blade portion including a cutting edge; and a back support including a top portion, side plates for supporting said thin blade portion therebetween and a pair of protrusions formed on said side plates in a longitudinal thereof at positions close to said lower ends of the blade holder, protrusion having two longitudinally extending contacting points, said protrusions away from said thin blade portion between said longitudinally extending contacting points and having inner surfaces facing and spaced from said thin blade portion, said thin blade portion being in contact with and supported by said longitudinally extending contacting points.

2. A blade according to claim 1, wherein said pair of protrusions are formed at positions near the cutting edge of said thin blade portion.

3. A blade according to claim 1, wherein said protrusions are formed in a substantially hemispheric or triangular shape.

4. A blade according to claim 1, wherein one of said side plates extends to a point midway between said cutting edge and a distal edge remote from said cutting edge of said thin blade portion, while the other side plate extends beyond the cutting edge of said thin blade portion such that a lower end of said other side plate covers said cutting edge with predetermined gaps in said other side plate to thereby form a comb-type edge adjacent said cutting edge.

5. A blade exchangeable razor comprising a blade holder and a blade which is adapted to be exchangeably mounted in a blade holder of the razor, said blade comprising:

a thin blade portion including a cutting edge; and a back support for the blade portion, said back support having side plate portions, said side plate portions of the back support including a pair of protrusions, each protrusion having two longitudinally extending contacting points, said protrusions disposed outwardly away from said thin blade portion between said longitudinally extending contacting points and having inner surfaces facing and spaced from said thin blade portion, the blade portion being supported by and clamped between said contacting points.

6. A blade exchangeable razor according to claim 5 wherein, said blade holder has a bifurcated opening for temporarily receiving the blade, the bifurcated opening having spaced apart lower ends, and wherein the outwardly disposed protrusions are formed at positions close to said lower ends of the blade holder.

7. A blade exchangeably razor according to claim 6, wherein the outwardly disposed protrusions are formed at positions in contact with said lower ends of the blade holder.

8. A blade exchangeable razor according to claim 5, wherein the outwardly disposed protrusions are formed in a substantially hemispheric or triangular shape.

9. A blade exchangeable razor having a blade and a blade holder assembly wherein said blade is adapted to be exchangeably mounted in a blade holder of the razor, said blade comprising:

a thin portion including a cutting edge; and a back support including a top portion, side plates for supporting said thin blade portion therebetween and a pair of protrusions formed on said side plates in a longitudinal direction thereof, each protrusion having two longitudinally extending contacting points, said protrusions protruding away from said thin blade portion between said longitudinally extending contacting points and having inner surfaces spaced from the thin blade portion, one of the protrusions having a longitudinally extending upper end and a longitudinally extending lower end, the lower end terminating before the cutting edge of the thin blade portion, the other protrusion having a longitudinally extending upper and a longitudinally extending lower end, and the lower end of the other protrusion extending beyond the cutting edge of said thin blade portion such that the lower end of the protrusion covers the cutting edge with predetermined gaps in the associated side plate to thereby form a comb-type edge adjacent the cutting edge, the thin blade portion being in contact with and supported by said contacting points.

10. A blade exchangeable razor according to claim 9, wherein the blade holder has a bifurcated opening for temporarily receiving the blade, the bifurcated opening having spaced apart lower ends, and wherein said protrusions formed on said side plates are disposed at positions close to said lower ends of the blade holder.

11. A blade exchangeable razor comprising a blade holder (22) and a blade (7) which is adapted to be exchangeably mounted in a blade holder (22) of the razor, said blade comprising:

a thin blade portion (8) including a cutting edge (10); and a back support (9) having side plate portions (9*a*, 9*b*) to support the blade portion (8) therebetween, and adapted to be mounted in the blade holder (22), a pair of protrusions formed on said side plates in a longitudinal direction thereof at positions close to said lower ends of the blade holder, each protrusion having two longitudinally extending contacting points, said protrusions protruding away from said thin blade portion between said longitudinally extending contacting points and having inner surfaces facing and spaced from said thin blade portion, said thin blade portion being in contact with and supported by said longitudinally extending contacting points, one of the side plate portions extending beyond the cutting edge (10) of the thin blade portion (8) and having a plurality of gaps therein such that a lower end of said one of the side plate portions covers the cutting edge (10) and such that said plurality gaps form a comb-type edge (11).

* * * * *